US010472222B2

(12) United States Patent
Qiu et al.

(10) Patent No.: US 10,472,222 B2
(45) Date of Patent: Nov. 12, 2019

(54) DOUBLE COOLED DRAFT BEER MACHINE

(71) Applicants: Diqing Qiu, Taizhou (CN); Dilin Qiu, Taizhou (CN)

(72) Inventors: Diqing Qiu, Taizhou (CN); Dilin Qiu, Taizhou (CN)

(73) Assignee: Diqing Qiu, Taizhou (CN)

( * ) Notice: Subject to any disclaimer, the term of this patent is extended or adjusted under 35 U.S.C. 154(b) by 330 days.

(21) Appl. No.: 15/418,676

(22) Filed: Jan. 28, 2017

(65) Prior Publication Data

US 2018/0099852 A1 Apr. 12, 2018

(30) Foreign Application Priority Data

Oct. 11, 2016 (CN) ..... 2016 1 0887573

(51) Int. Cl.

| | |
|---|---|
| ***B67D 1/08*** | (2006.01) |
| ***B67D 1/00*** | (2006.01) |
| ***F25D 11/00*** | (2006.01) |
| ***F25D 23/02*** | (2006.01) |
| ***F25D 23/06*** | (2006.01) |

(Continued)

(52) U.S. Cl.

CPC ..... *B67D 1/0867* (2013.01); *B67D 1/0004* (2013.01); *B67D 1/0891* (2013.01); *F25D 11/00* (2013.01); *F25D 23/02* (2013.01); *F25D 23/062* (2013.01); *F25D 29/00* (2013.01); *F25D 31/002* (2013.01); *F25D 31/006* (2013.01); *F25D 2400/28* (2013.01); *F25D 2700/16* (2013.01)

(58) Field of Classification Search

CPC ..... B67D 1/0858; B67D 1/06; B67D 1/0884; B67D 1/0891; B67D 1/0004; F25D 31/002; F25D 29/00; F25D 2700/16

See application file for complete search history.

(56) References Cited

U.S. PATENT DOCUMENTS 1,811,215 A * 6/1931 Smith ..... F25D 31/003 62/395
2,125,248 A * 7/1938 Taylor ..... B67D 1/04 137/170.3

(Continued)

FOREIGN PATENT DOCUMENTS

CN 2306223 Y 2/1999
CN 201322507 Y 10/2009

(Continued)

*Primary Examiner* — Kun Kai Ma

(74) *Attorney, Agent, or Firm* — Minder Law Group; Willy H. Wong

(57) ABSTRACT

A draft beer machine comprising a cabinet, and a refrigeration circuit inside the cabinet, including a compressor, a condenser, and an evaporator. Inside the cabinet, a cold storage chamber is used to hold the cask, and the evaporator can refrigerate the cold storage chamber. A beer pipe is also inside the cabinet, and a beer tap is fixed to the outside of the cabinet. The outer end of the beer pipe is connected to the beer tap, and its inner end is used to connect to the cask. The cold storage chamber has a single chamber structure. Inside the cold storage chamber, there is a refrigeration tube. The refrigeration tube is connected to the refrigeration circuit and is in parallel with the evaporator. The refrigeration tube and the beer pipe are wound into a quick cooler of a round or an elliptic cylindrical shape, in an abreast and helical manner.

19 Claims, 13 Drawing Sheets

(51) Int. Cl.
*F25D 29/00* (2006.01)
*F25D 31/00* (2006.01)

(56) References Cited

U.S. PATENT DOCUMENTS 2,125,261 A * 7/1938 Stern ..... B67D 1/0859 137/614.04
2,144,005 A * 1/1939 Wilson ..... F25D 31/002 62/258
2,235,244 A * 3/1941 Ames ..... F25D 31/002 165/145
2,249,074 A * 7/1941 Wolfert ..... F25B 39/02 62/225
2,317,484 A * 4/1943 Richmond ..... F25D 31/002 62/223
2,325,228 A * 7/1943 Cornelius ..... B67D 1/06 137/338
2,508,247 A * 5/1950 Giauque ..... F28D 7/024 165/163
2,653,014 A * 9/1953 Sniader ..... F25D 31/002 165/140
2,682,160 A * 6/1954 Kromer ..... F25D 31/002 62/177
3,017,753 A * 1/1962 Schirp ..... F25D 31/002 62/395
3,050,954 A * 8/1962 Royse ..... B01D 53/265 55/391
3,131,553 A * 5/1964 Ross ..... F25B 39/00 165/140
3,898,861 A * 8/1975 McMillin ..... B67D 1/0021 62/177
3,995,441 A * 12/1976 McMillin ..... B67D 1/005 62/177
4,036,621 A * 7/1977 Burton ..... F25B 39/02 165/172
4,429,737 A * 2/1984 McManus ..... F28D 1/06 165/125
4,462,220 A * 7/1984 Iannelli ..... B67D 1/06 165/163
4,462,463 A * 7/1984 Gorham, Jr. ..... F28D 7/0066 165/140
4,730,463 A * 3/1988 Stanfill ..... B67D 1/0867 222/146.6
4,782,815 A * 11/1988 Friedman ..... F24H 1/43 122/18.4
4,979,647 A * 12/1990 Hassell ..... B67D 1/0057 222/129.1
5,537,838 A * 7/1996 Mills ..... B67D 1/06 62/400
5,974,824 A * 11/1999 Galockin ..... B67D 1/0864 222/146.6
6,178,875 B1 * 1/2001 Edwards ..... A23L 2/54 261/128
6,438,989 B1 * 8/2002 Wolski ..... B67D 1/0864 62/299
8,453,882 B2 * 6/2013 Johnson ..... B67D 1/0864 222/146.6
2001/0000107 A1 * 4/2001 Simmons ..... B67D 1/0864 222/129.1
2006/0272348 A1 * 12/2006 Kyees ..... B67D 1/0858 62/390
2008/0141702 A1 * 6/2008 Gagliano ..... B67D 1/0007 62/389
2008/0149317 A1 * 6/2008 Baker ..... F28D 7/022 165/163
2011/0006078 A1 * 1/2011 Hsu ..... B67D 3/0009 222/129
2011/0147194 A1 * 6/2011 Kamen ..... B01D 1/0082 202/185.1
2017/0183210 A1 * 6/2017 Wyatt ..... B67D 1/0864

FOREIGN PATENT DOCUMENTS

CN 204574693 U 8/2015
CN 104896871 A 9/2015

* cited by examiner

DOUBLE COOLED DRAFT BEER MACHINE

RELATED APPLICATIONS

This application claims benefit of Chinese Patent Application No. CN201610887573.X, filed Oct. 11, 2016.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present double cooled draft beer machine relates to the technical field of beverage equipment, and particularly to a double cooled draft beer machine.

Related Art

With the progress of the times, and the improvement of people's quality of life, people have a higher requirement for drinking beer. It has been difficult for canned or bottled beer to meet people's drink demand, and more and more people hope they could drink fresh, hygiene, palatable, and pure draft beer. A draft beer machine is a device to cool the beer. Traditional draft beer machines are used in coordination with the carbon dioxide cylinder and casks. Beer at normal temperature is stored in the casks, and by applying the pressure from the carbon dioxide cylinder, the beer in the cask will be pressed out and flows into the draft beer machine. The draft beer machine will refrigerate the beer passing through it, and then beer flows out of the draft beer machine and arrives at the tap. People drink beer as soon as they open the tap.

One prior art device comprises a gas cylinder, a water purification device, a cleaning tank, a beer cask, a refrigeration system, a heat exchanger, and a beer dispensing section. The gas cylinder is connected to the intake valve pipe of the cleaning tank, the gas cylinder is connected to the intake valve pipe of the beer cask, the water purification equipment is connected to the reversing valve pipe of the cleaning tank, and the reversing valve of the cleaning tank is connected to the reversing valve pipe of the beer cask. The reversing valve of the beer cask is connected to the heat exchanger pipe, the heat exchanger is connected to the pipe of the beer dispensing section, and the heat exchanger is placed inside the refrigeration system. This draft beer machine organically combines the cleaning management and refrigeration, and achieves refrigeration and cleaning quickly. This not only ensures the beer is cool, but also and more importantly ensures the freshness.

Although this draft beer machine can achieve the refrigeration of beer, it has the disadvantage of slow refrigeration speed. Specifically, this draft beer machine cools the water in the water tank by the compressor, and the beer pipe is located inside the water tank. Therefore, when beer passes through the beer pipe, it is cooled. Because it takes some time for the temperature of the water in the water tank to drop, when the draft beer machine is switched on, the discharged beer has not been cooled yet in fact. Therefore, it does not achieve a quick cool in the draft beer machine.

Also, when this draft beer machine is in operation, the cask is placed outside the draft beer machine. The cask is in an environment at a normal temperature. This leads to a short shelf life of the beer in the cask. It is easy to spoil and the quality of beer is affected.

SUMMARY OF THE INVENTION

One objective of one embodiment of the present invention is to avoid the issues stated above in the prior art, and to provide a double cooled draft beer machine. One technical issue to be resolved by one embodiment of the present invention is how to make the draft beer machine utilize the cooling capacity highly efficiently and improve the refrigeration effect to discharged beer.

One objective of one embodiment of the present invention can be achieved by the following proposal:

A double cooled draft beer machine comprises a cabinet, and there is a refrigeration circuit inside the cabinet, including a compressor, a condenser, and an evaporator. Inside the cabinet, there is a cold storage chamber used to hold the cask, and the evaporator can refrigerate the cold storage chamber. A beer pipe is also arranged inside the cabinet, and a beer tap is fixed to the outside of the cabinet. The outer end of the beer pipe is connected to the beer tap, and its inner end is used to connect to the cask. It is characterized in that:

The cold storage chamber has a single chamber structure. Inside the cold storage chamber, there is a refrigeration tube. The refrigeration tube is connected to the refrigeration circuit and is in parallel with the evaporator. The refrigeration tube and the beer pipe are wound into a quick cooler of a round or an elliptic cylindrical shape, in an abreast and helical manner.

The cold storage chamber of the draft beer machine is used to hold the cask, and the evaporator can refrigerate the cold storage chamber, making the cold storage chamber to maintain a range of relatively low temperature. This improves the shelf life of beer and prevents beer from spoiling. The quick cooler in the present invention is formed by winding the refrigeration tube and the beer pipe in an abreast and helical manner. The abreast manner makes the refrigeration tube directly adhere to the beer pipe to achieve the refrigeration. The cooling capacity is transferred more quickly, so the refrigeration effect is higher, the start-up waiting time of the machine is reduced. Features of "pre-cooling no longer needed" and "switch on and ready to use" are achieved. The helical manner allows a long contact distance between the refrigeration tube and the beer pipe, and allows a long refrigeration path for beer in the beer pipe, so as to utilize the cooling capacity inside the refrigeration tube highly efficiently, to improve the refrigeration effect of the refrigeration tube to the beer pipe, and to ensure a relatively low serving temperature of the beer. Also, the quick cooler is wound into a round or an elliptic cylindrical shape. This ensures that the fluids in the beer pipe and the refrigeration tube flow fluently, can further ensure a uniform distribution of cooling capacity to improve the refrigeration efficiency, and prevents the tubes from being clogged by ice due to non-uniform local cooling capacity.

In addition, the refrigerant flows through the refrigeration tube, so the temperature of the refrigeration tube is very low. While the refrigeration tube is refrigerating the beer pipe, some cooling capacity will diffuse outward. Both of the refrigeration tube and the cask are located inside the cold storage chamber. Also, since the cold storage chamber has a single chamber structure, when the refrigeration tube is refrigerating the beer pipe, the diffused cooling capacity can also be used to lower the temperature of the cold storage chamber and hence to refrigerate the cask. Such a design makes the utilization of the cooling capacity more efficiently, and hence improves the refrigeration effect.

In the double cooled draft beer machine, a door which can open or close the cold storage chamber is arranged at the front of the cabinet, and the quick cooler is located in the rear of the cold storage chamber. Several casks are placed in the cold storage chamber in general. When the beer in the casks runs out, the empty casks can be replaced with new casks after the door is opened. During open and close of the door, some cooling capacity will diffuse, so the quick cooler is arranged in the rear of the cold storage chamber, away from the door, so that the outward diffusion of the cooling capacity of the quick cooler is minimized, the energy loss is reduced, and the refrigeration effect is improved.

In the double cooled draft beer machine, the cabinet comprises a housing and an inner container arranged inside the housing. The inner cavity of the inner container is the cold storage chamber, and there is a space between the outer wall of the inner container and the inner wall of the housing. Such a structure forms a double layered structure of the cabinet, which insulates and minimizes the outward diffusion of the cooling capacity inside the cold storage chamber, so as to utilize the cooling capacity highly efficiently, and improves the refrigeration effect of the discharged beer.

In the double cooled draft beer machine, a mounting cover is fixed to the top of the inner wall of the inner container, and the evaporator is arranged between the mounting cover and the inner container. On the mounting cover, there is also a blower which can blow the cold air diffused from the evaporator into the cold storage chamber. The cask is placed in the cold storage chamber, and there is a certain space between the top of the cask and the top wall of the inner container. Therefore, by arranging the evaporator in the mounting cover, the evaporator is also located in the top of the cold storage chamber. The wind sent out by the blower will not be blocked by the cask, which facilitates the circulation of cold air, so as to utilize the cooling capacity highly efficiently and improves the refrigeration effect of the cold storage chamber.

In the double cooled draft beer machine, the quick cooler comprises at least one mixing layer, which is formed by winding the refrigeration tube and the beer pipe into a round or elliptic cylinder, in an abreast and helical manner. In the same mixing layer, the adjacent beer pipe and refrigeration tube adhere to each other. The adjacent two mixing layers directly adhere or a thermal conductive medium is filled in between the two layers. In the mixing layer, the beer pipe and the refrigeration tube adhere to each other, ensuring that the cooling capacity of the refrigeration tube will be transferred to the beer pipe highly efficiently, so as to refrigerate the beer pipe. A thermal conductive medium may be filled in between the two adjacent mixing layers, which can further expedite the efficiency of cooling capacity transfer and improves the refrigeration efficiency. The advantages of the mixing layer having a multiple layer structure is that: on one hand, the contact length between the refrigeration tube and the beer pipe is increased, the refrigeration path is increased and hence the refrigeration effect is improved; on the other hand, the refrigeration tube in each mixing layer can refrigerate the beer pipe in the adjacent mixing layer, and the cooling capacity of the refrigeration tube is utilized more efficiently, so as to improve the refrigeration effect.

In the double cooled draft beer machine, a refrigeration layer is arranged inside the innermost mixing layer. The refrigeration layer is formed by winding the refrigeration tubes into a round or elliptic cylinder, in a helical manner. The refrigeration layer and the innermost mixing layer directly adhere or a thermal conductive medium is filled in between the two layers. The quick cooler is wrapped and formed by several cylindrical mixing layers, so a cylindrical cavity is formed inside the innermost mixing layer. This cavity is the core of the whole quick cooler, and the cooling capacity gathers here and reaches the peak. By arranging a refrigeration layer which is formed only by refrigeration tubes, inside the innermost mixing layer, the refrigerant in the refrigeration tubes can fully absorb the cooling capacity inside the cavity to store cooling capacity. This avoids waste of cooling capacity, and transfers cooling capacity to beer through the refrigerant, so as to fulfill the purpose of improving the refrigeration efficiency to beer. The refrigeration layer is arranged in a round or an elliptic cylindrical shape, presenting smooth flow transport on the refrigeration tubes. This ensures that the fluid in the refrigeration tubes flows fluently, prevents the tubes from being clogged by ice due to non-uniform local cooing capacity and ensures a uniform distribution of cooling capacity to improve the refrigeration efficiency.

In the double cooled draft beer machine, a beer pipe layer is sleeved over the outside of the outermost mixing layer. The beer pipe layer is formed by winding the beer pipes into a round or elliptic cylinder, in a helical manner. The beer pipe layer and the outermost mixing layer directly adhere or a thermal conductive medium is filled in between the two layers. A beer pipe layer is sleeved over the outside of the outermost mixing layer. The beer pipe layer can reduce the dissipation of the cooling capacity in the mixing layer, and can ensure that the refrigerant always has a low temperature and achieve the quick refrigeration to beer. The beer pipe layer and the outermost mixing layer directly adhere or a thermal conductive medium may be filled in between them, which can further expedite the efficiency of cooling capacity transfer and improves the refrigeration efficiency.

In the double cooled draft beer machine, the quick cooler is formed by winding one refrigeration tube and at least two beer pipes. Each beer pipe is wound into each mixing layer. Each beer pipe is successively wound into each mixing layer, making each beer pipe refrigerated by each mixing layer. This ensures a long refrigeration path, and hence improves the refrigeration effect.

In the draft beer machine, the beer pipe of the innermost mixing layer is used to connect to the cask, and the beer pipe of the beer pipe layer is connected to the beer tap. The refrigeration tube of the outermost mixing layer is connected to the condenser, and the refrigeration tube of the refrigeration layer is connected to the compressor. The refrigerant outflowing from the condenser has a fairly low initial temperature. Namely, the end connected to the condenser is the inlet end of the refrigeration tube. In the present invention, the refrigeration tube in the outermost mixing layer is connected to the condenser, ensuring that the temperature in the outermost mixing layer is always fairly low. Namely, the inlet end of the refrigerant in the quick cooler is located in the outermost mixing layer, and the outlet end is located in the innermost refrigeration layer of the whole quick cooler. Also, the inlet end of beer in the present invention is located in the innermost mixing layer, and the outlet end is located in the outermost beer pipe layer of the whole quick cooler. Therefore, the outlet end of beer is next to the inlet end of the refrigerant, and the inlet end of beer is next to the outlet end of the refrigerant. Beer and the refrigerant form a relative counter-current structure, ensuring that the outlet end of beer can always has a fairly low temperature and this further improves the refrigeration efficiency of discharged beer.

In the double cooled draft beer machine, a shell used to accommodate the quick cooler is arranged outside the quick cooler. The quick cooler is located inside the shell, and an insulation layer is set up between the quick cooler and the inner wall of the shell. The main function of the quick cooler is refrigerating the beer pipe, so a shell is arranged and an insulation layer is arranged inside the shell. This can prevent the cooling capacity of the refrigeration tube from diffusing to the outside of the shell, and ensures that more cooling capacity gathers inside shell and gets fully utilized. However, inevitably, little cooling capacity will still diffuse to the outside of the shell. Since the quick cooler is located inside the cold storage chamber, the diffused cooling capacity can also be utilized to refrigerate the cold storage chamber, making the present draft beer machine to achieve a high efficient utilization of the cooling capacity and improve the refrigeration effect to discharged beer.

In the double cooled draft beer machine, in its refrigeration circuit, at least one solenoid valve is set up, which is used to open or close the refrigeration circuit for the refrigerant to flow toward the refrigeration tube or the evaporator. The present double cooled draft beer machine also comprises a relay used to control the action of the solenoid valve and the first thermostat used to detect the temperature. The detection point of the first thermostat is located between the refrigeration tube and the beer pipe. The first thermostat is in parallel with the relay, and the contact of the relay is connected to the solenoid of the solenoid valve, as well as the compressor. When the temperature detected by the first thermostat is higher than the first upper limit temperature threshold set by the first thermostat, the relay controls the solenoid valve to allow the refrigerant in the refrigeration circuit to stop flowing toward the evaporator, and to flow toward the refrigeration tube only. When the temperature detected by the first thermostat is equal to or lower than the first lower limit temperature threshold set by the first thermostat, the relay controls the solenoid valve to allow the refrigerant in the refrigeration circuit to stop flowing toward the refrigeration tube. The temperature detected by the first thermostat may be the temperature of the beer pipe or the temperature of the refrigeration tube. When a temperature conductive medium, such as the temperature conductive mud, is arranged between the refrigeration tube and the beer pipe, the temperature detected by the first thermostat may also be the temperature of the temperature conductive mud, the temperature detected by the first thermostat after the draft beer machine is switched on. The present draft beer machine achieves the refrigeration to the evaporator and the refrigeration tube respectively through one compressor. When the temperature detected by the first thermostat of the draft beer machine is higher than the first upper limit temperature threshold set by the first thermostat, the relay controls the solenoid valve to allow the refrigerant in the refrigeration circuit to flow toward the refrigeration tube only. Therefore, regarding the distribution of the cooling capacity, the present draft beer machine refrigerates the beer pipe first. This is reflected in that:

On one hand, when the draft beer machine is switched on and in operation, the temperature of the cold storage chamber and the temperature inside the beer pipe are both relatively high. At this point, the solenoid valve makes the refrigerant flow toward the refrigeration tube only, and the beer pipe is refrigerated first. When the temperature detected by the first thermostat is equal to or lower than the first lower limit temperature threshold, it is then switched to refrigerate the cold storage chamber. This manner can ensure that the draft beer machine can fulfill the refrigeration of discharged beer quickly, features of "pre-cooling no longer needed" and "switch on and ready to use" are achieved. On the other hand, during the refrigeration process of the cold storage chamber, no matter whether the cold storage chamber reaches the appropriate temperature range or not, if the beer tap is opened frequently to discharge beer, the temperature detected by the first thermostat is higher than the first upper limit temperature threshold set by the first thermostat. At this point, the relay will control the solenoid valve to act and forcibly switch, to allow the refrigerant in the refrigeration circuit to stop flowing toward the evaporator, and to flow toward the refrigeration tube only. The beer pipe is then refrigerated so that it ensures cool beer can be served whenever the beer tap is opened.

In the double cooled draft beer machine, the second thermostat which can detect the inner temperature of the cold storage chamber is arranged inside the cold storage chamber. The second thermostat is in series with a series branch consisting of the first thermostat and the relay. When the temperature detected by the first thermostat is equal to or lower than the first lower limit temperature threshold, and the inner temperature of the cold storage chamber is higher than the second upper limit temperature threshold set by the second thermostat, the relay controls the solenoid valve to allow the refrigerant in the refrigeration circuit to flow toward the evaporator. When the temperature detected by the first thermostat is equal to or lower than the first lower limit temperature threshold, and the inner temperature of the cold storage chamber is equal to or lower than the second lower limit temperature threshold set by the second thermostat, the second thermostat switches off and makes the compressor stop working. The second thermostat detects the temperature of the cold storage chamber. Only when the refrigeration to the refrigeration tube is fulfilled, will the cold storage chamber be refrigerated, so as to ensure beer always flows out at a relatively low temperature. When the temperature detected by the first thermostat and the temperature of the cold storage chamber are equal to or lower than the set first lower limit temperature threshold and the set second lower limit temperature threshold respectively, the second thermostat switches off and interrupts the power supply of the compressor and stops its operation.

In the double cooled draft beer machine, the solenoid valve is a 3-way solenoid valve. The inlet of the 3-way solenoid valve is connected to the refrigerant outlet of the condenser, one outlet of the 3-way solenoid valve is connected to the refrigeration tube, and the other outlet is connected to the evaporator. The 3-way solenoid valve has one inlet and two outlets. When the 3-way solenoid valve is powered on, the inlet is connected to the outlet which is connected to the refrigeration tube. When it is powered off, the inlet is connected to the outlet which is connected to the evaporator.

In the double cooled draft beer machine, there are two solenoid valves: the first solenoid valve and the second solenoid valve. The inlet of the first solenoid valve is connected to the refrigerant outlet of the condenser, and the outlet is connected to the refrigeration tube. The inlet of the second solenoid valve is connected to the refrigerant outlet of the condenser, and the outlet is connected to the evaporator. The relay has both a normally open contact and a normally closed contact. The normally open contact is connected to the first solenoid valve and the normally closed contact is connected to the second solenoid valve. When the relay is powered on, the normally closed contact will be disconnected to switch off the second solenoid valve, and the normally open contact is on to switch on the first solenoid valve, so the refrigerant flow toward the refrigeration tube only.

Compared to the prior art, one embodiment of the present double cooled water cooled draft beer machine has the following advantages:

1. The cold storage chamber of the present draft beer machine has a single chamber structure. The cask and the quick cooler are both arranged inside the cold storage chamber. Cooling capacity which is not fully utilized yet by the quick cooler can diffuse to the cold storage chamber, so as to reduce the overall temperature of the cold storage chamber. It can refrigerate the cask placed in the cold storage chamber, improves the overall utilization of cooling capacity, and further improves the refrigeration efficiency.

2. The quick cooler of the present draft beer machine achieves the transfer of the cooling capacity between the refrigeration tube and the beer pipe in the form of dry contact cooling. Compared to other refrigeration methods such as water cooling, dry contact cooling has an advantage of high efficiency of cooling capacity transfer, and can achieve a quick cooling effect. No water tank is required, thus the water refilling hassle is gone, and the maintenance and usage is convenient.

3. In the present draft beer machine, since the refrigeration tube directly adheres to the beer pipe, compared to water cooling, the process from power-on to the fulfillment of the refrigeration is quicker. The waiting time after power-on can be reduced, and features of "pre-cooling no longer needed" and "switch on and ready to use" are achieved.

DETAILED DESCRIPTION OF THE INVENTION

Figure 1:
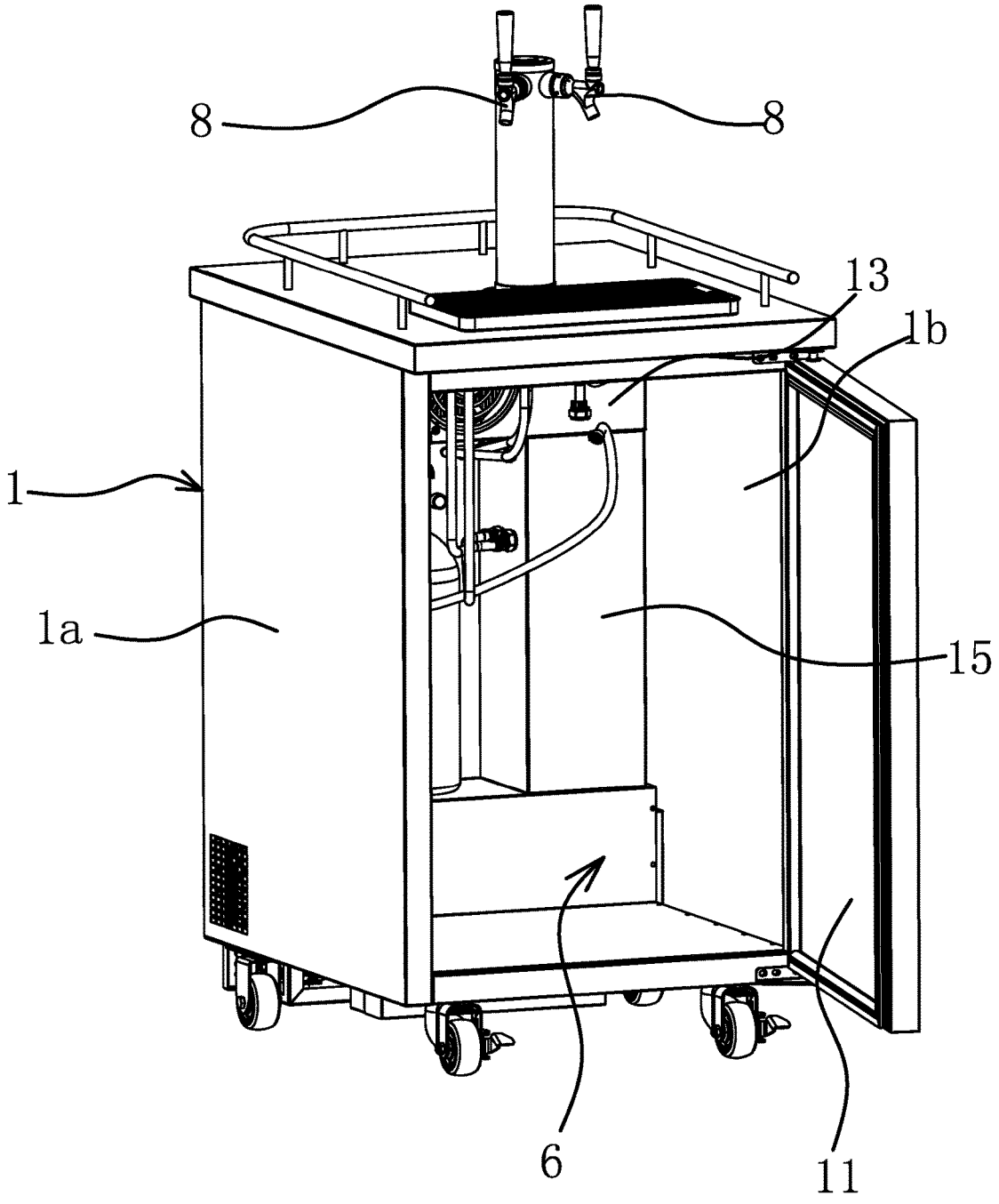
FIG. 1 is a perspective view of one embodiment of the double cooled draft beer machine.

The embodiments of this invention will be described below and the technical solutions of the invention will be further illustrated in connection with the accompanying figures. However, the present invention shall not be limited to these embodiments.

First Embodiment

As shown in FIG. 1 through FIG. 5, one embodiment of the present double cooled draft beer machine comprises a cabinet (1). Inside the cabinet (1), there is a cold storage chamber (6) used to hold the cask (5). A door which can open or close the cold storage chamber (6) is arranged in the front of the cabinet (1). A beer pipe (7), a compressor (2), a condenser (3) and an evaporator (4) are also arranged inside the cabinet (1), and a beer tap (8) is fixed to the outside of the cabinet (1). The inner end of the beer pipe (7) is connected to the cask (5), and the outer end of the beer pipe (7) is connected to the beer tap (8).

Figure 4:
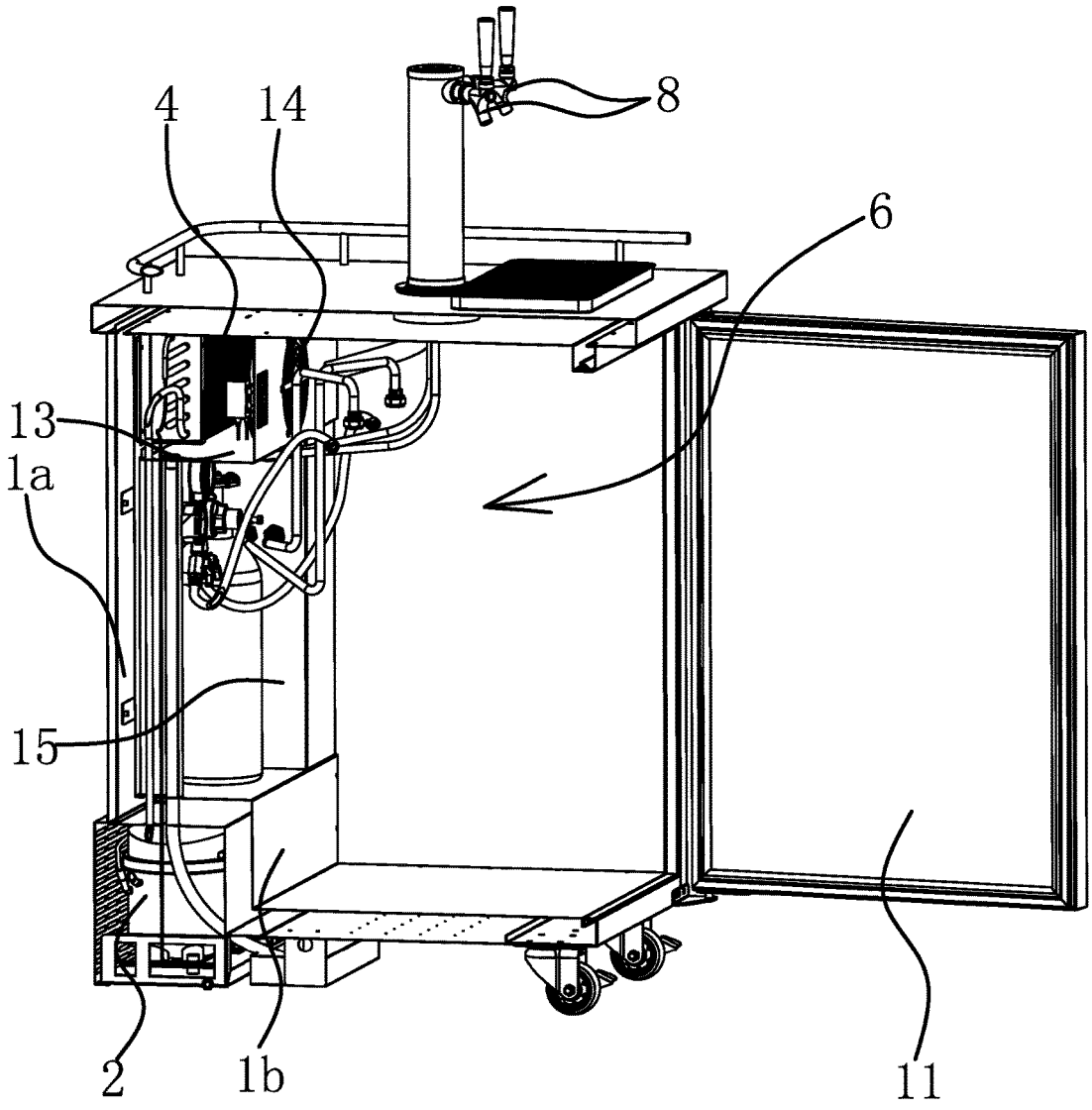
FIG. 4 is a first schematic view of one embodiment of an inside of the double cooled draft beer machine.
Figure 5:
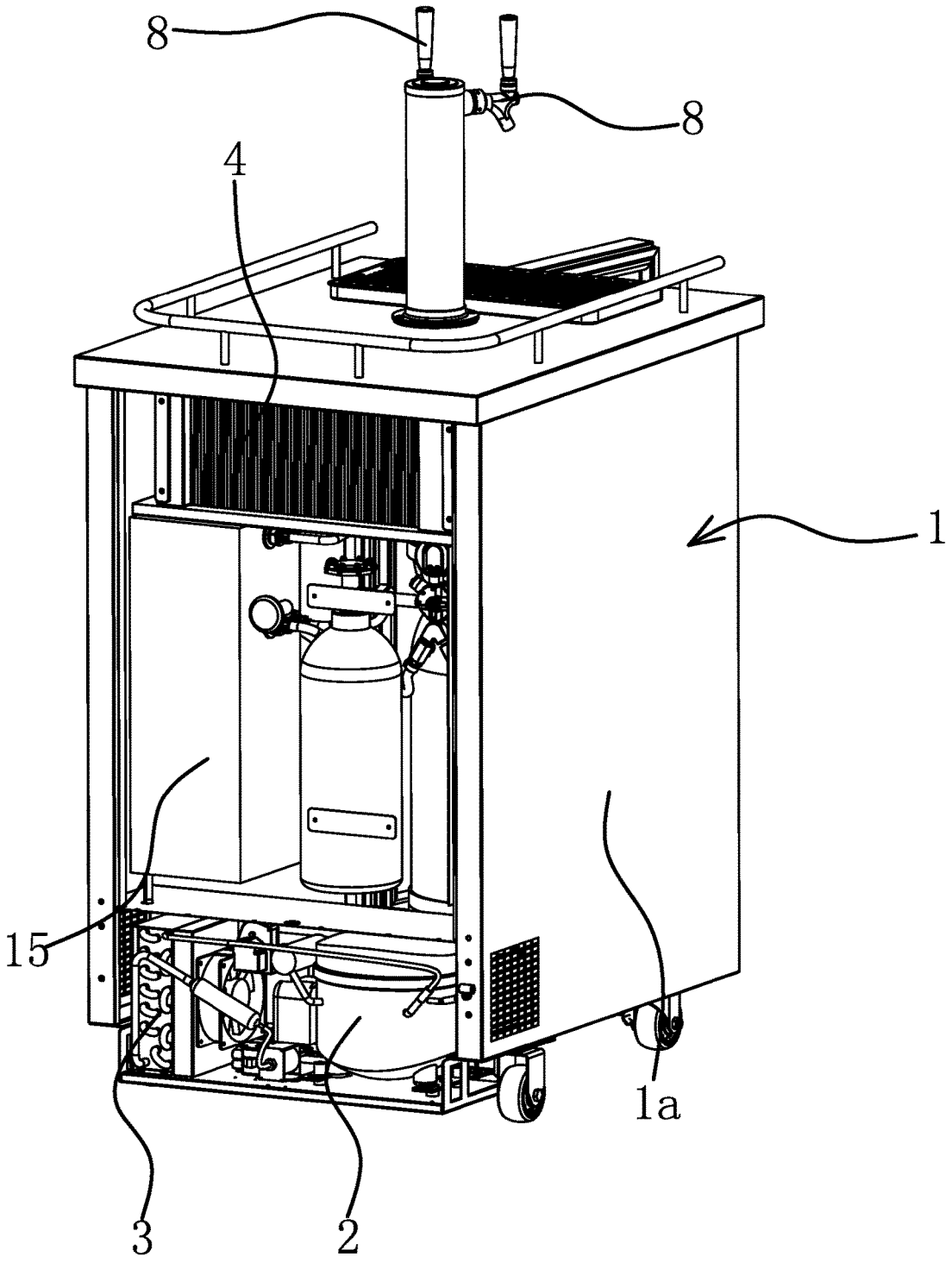
FIG. 5 is a second schematic view of one embodiment of an inside of the double cooled draft beer machine.

As shown in FIG. 4, the cabinet (1) comprises a housing (1*a*) and an inner container (1*b*) arranged inside the housing (1*a*). The inner cavity of the inner container (1*b*) is the cold storage chamber (6), and there is a space between the outer wall of the inner container (1*b*) and the inner wall of the housing (1*a*).

The present draft beer machine achieves a double cooling function through one compressor (2). The compressor (2), the condenser (3) and the evaporator (4) form a refrigeration circuit. A condenser blower (24) is also arranged on one side of the condenser (3). The evaporator (4) can refrigerate the cask (5) inside the cold storage chamber (6), making the present draft beer machine to have a refrigeration function. In addition, a refrigeration tube (9) is connected to the refrigeration circuit, and the refrigeration tube (9) is in parallel with the evaporator (4). The refrigeration tube (9) can refrigerate the beer pipe (7), making the present draft beer machine to have a quick cooling function to achieve quick refrigeration.

Specifically, as shown in FIG. 4, a mounting cover (13) is fixed to the top of the inner wall of the inner container (1*b*), and the evaporator (4) is arranged between the mounting cover (13) and the inner container (1*b*). On the mounting cover (13), there is also a blower (14). The blower (14) can blow the cold air diffused from the evaporator (4) into the cold storage chamber, making the cold storage chamber to maintain a range of relatively low temperature. This improves the shelf life of beer and prevents beer from spoiling. The evaporator (4) is also located in the top of the cold storage chamber. The wind sent out by the blower (14) will not be blocked by the cask (5), which facilitates the circulation of cold air, so as to utilize the cooling capacity efficiently and improves the refrigeration effect of the cold storage chamber (6).

Figure 2:
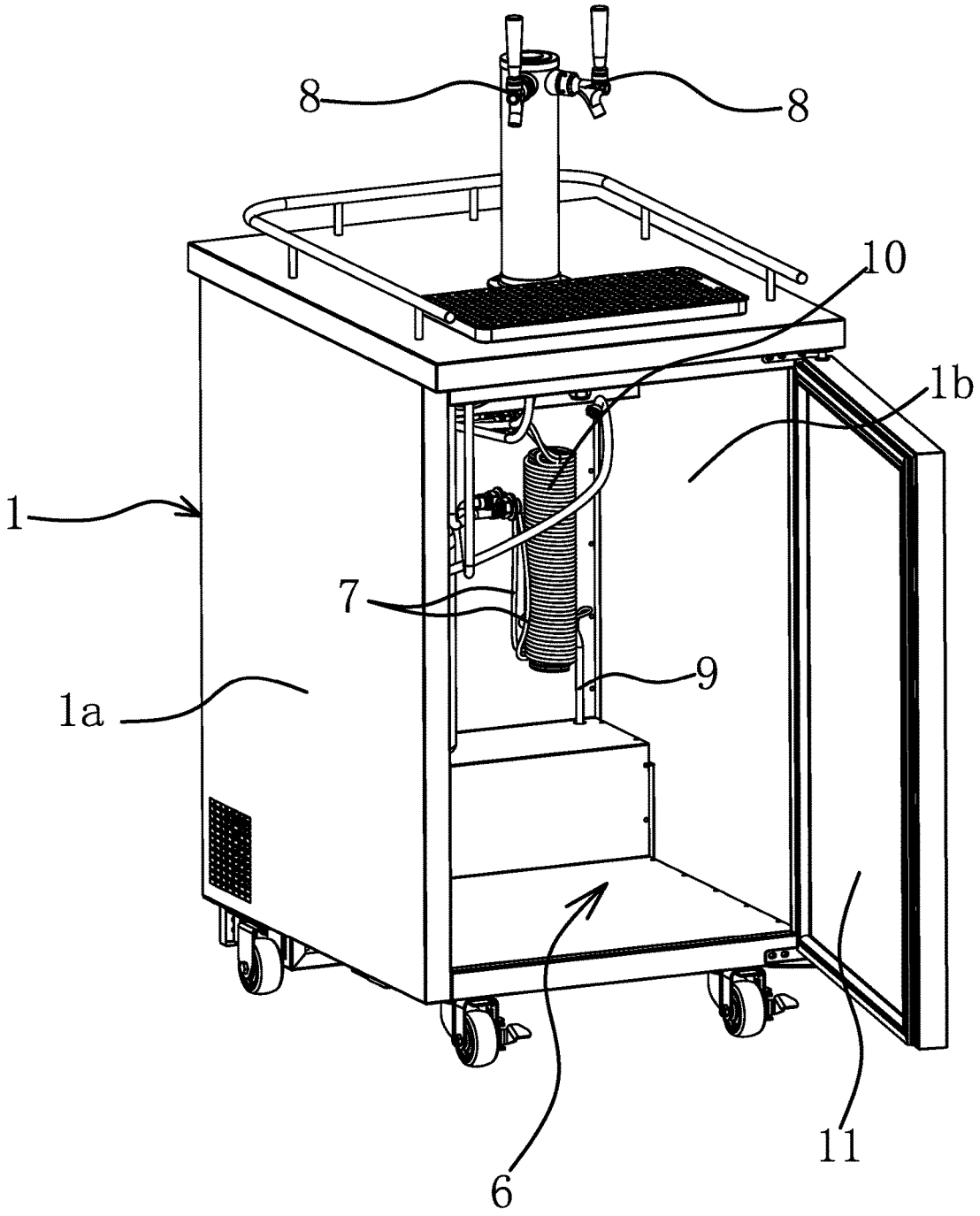
FIG. 2 is a perspective view of one embodiment of the double cooled draft beer machine where a shell and an insulation layer are omitted.
Figure 3:
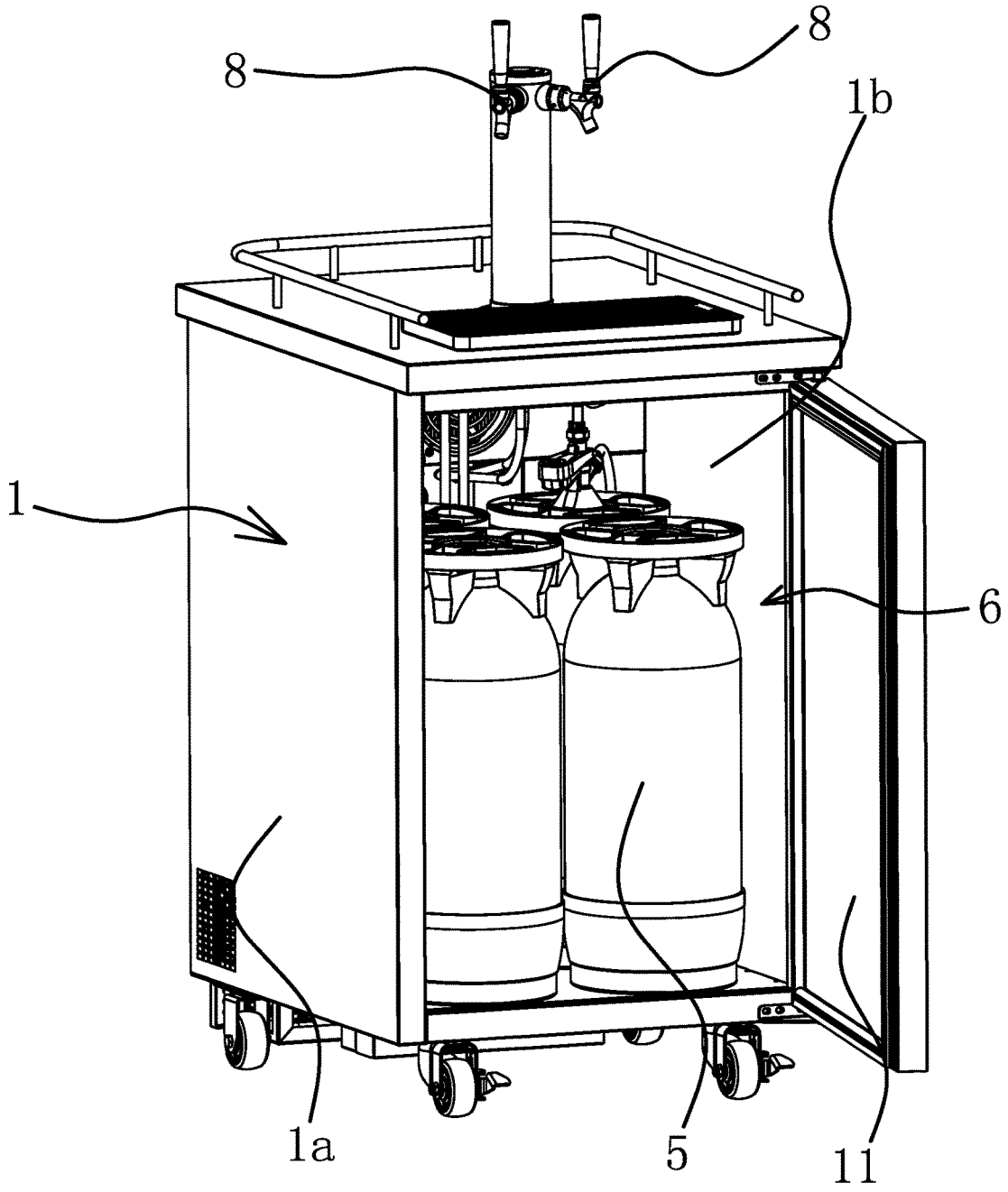
FIG. 3 is a perspective view of one embodiment of the double cooled draft beer machine in use.
Figure 6:
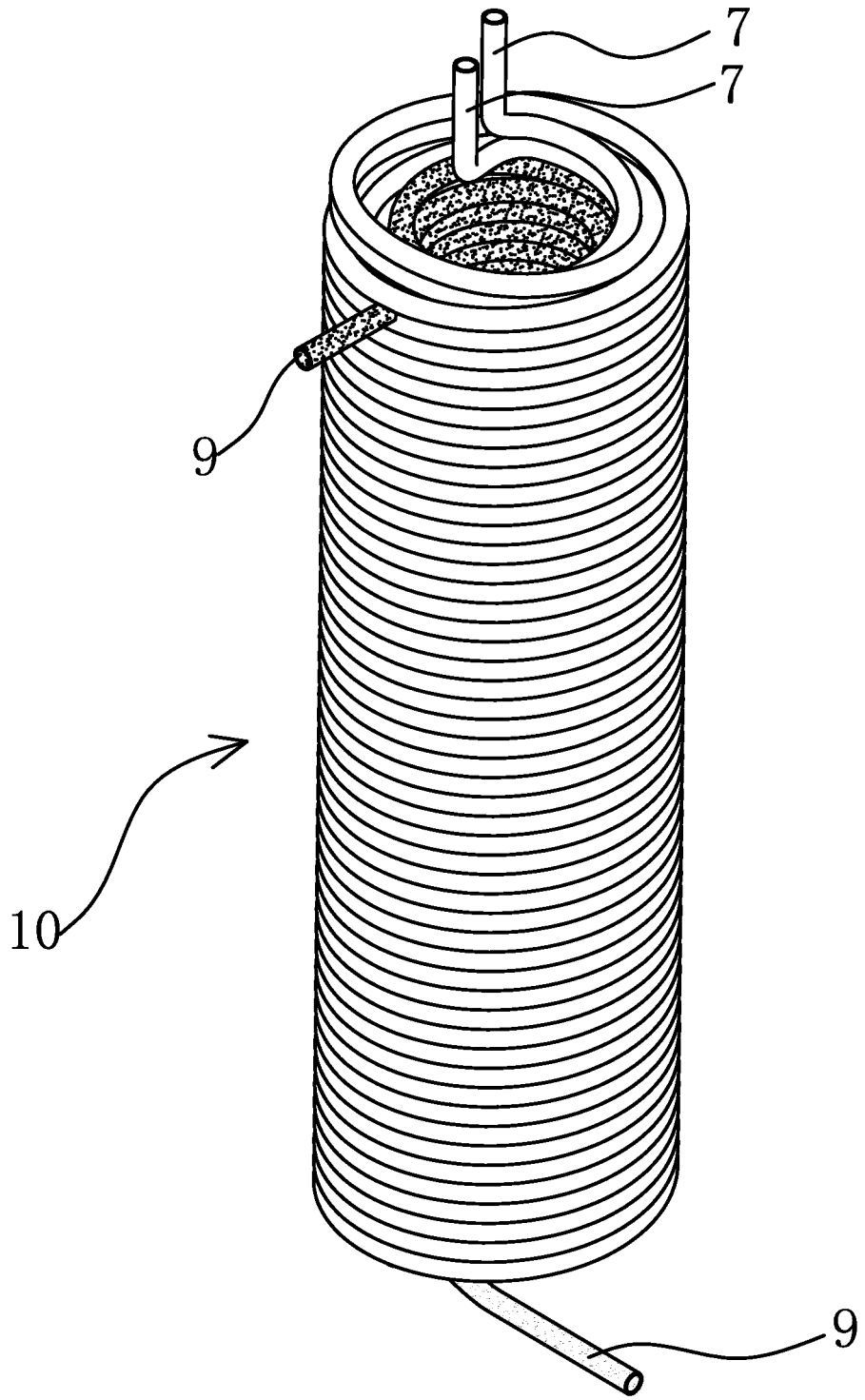
FIG. 6 is a perspective view of one embodiment of a quick cooler in the double cooled draft beer machine.

The cold storage chamber (6) has a single chamber structure, and both of the refrigeration tube (9) and the cask (5) are located inside the cold storage chamber (6). When the refrigeration tube (9) is refrigerating the beer pipe (7), the diffused cooling capacity can also be used to lower the temperature of the cold storage chamber (6) and hence to refrigerate the cask (5). Such a design makes the utilization of the cooling capacity more efficiently, and hence improves the refrigeration effect. As shown in FIG. 2 and FIG. 6, a round quick cooler (10) is formed by winding the refrigeration tubes (9) and beer pipes (7) in an abreast and helical manner. The quick cooler (10) is located in the rear of the cold storage chamber (6). The quick cooler (10) is arranged in the rear of the cold storage chamber (6), making the quick cooler (10) away from the door (11), so that the outward diffusion of the cooling capacity of the quick cooler (10) is minimized, the energy loss is reduced, and the refrigeration effect is improved. The helical manner allows a long contact distance between the refrigeration tube (9) and the beer pipe (7), and allows a long refrigeration path for beer in the beer pipe (7), so as to utilize the cooling capacity inside the refrigeration tube (9) highly efficiently, to improve the refrigeration effect of the refrigeration tube (9) to the beer pipe (7), and to ensure a relatively low serving temperature of the beer.

Figure 7:
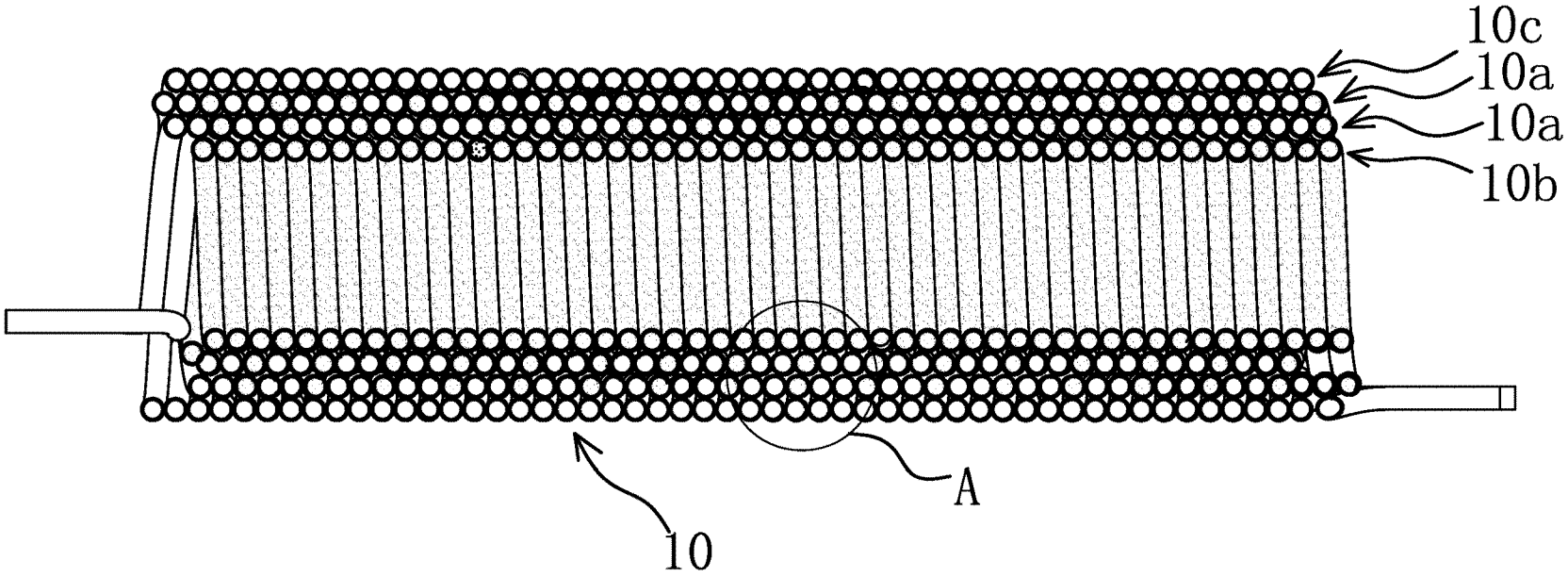
FIG. 7 is a sectional view of one embodiment of the double cooled draft beer machine.
Figure 8:
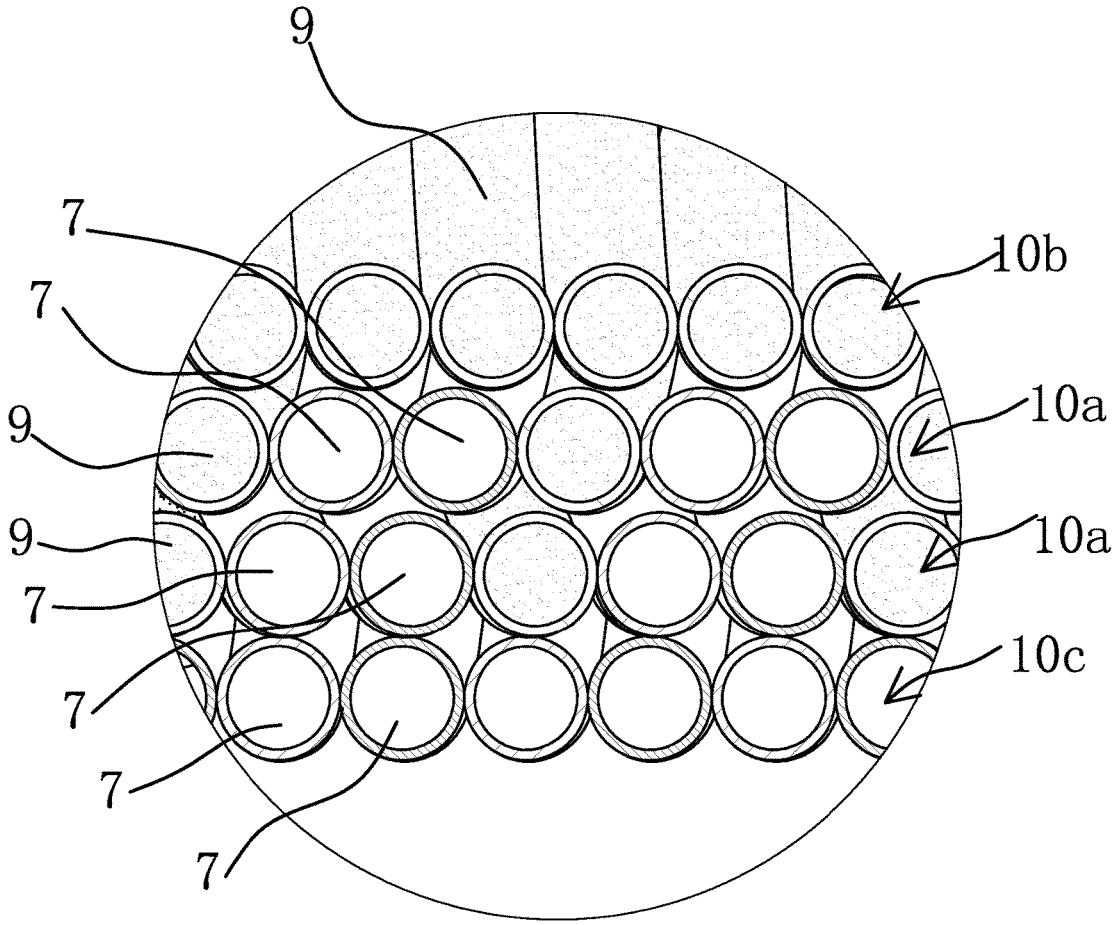
FIG. 8 is a detailed view of Section A in FIG. 7.
Figure 9:
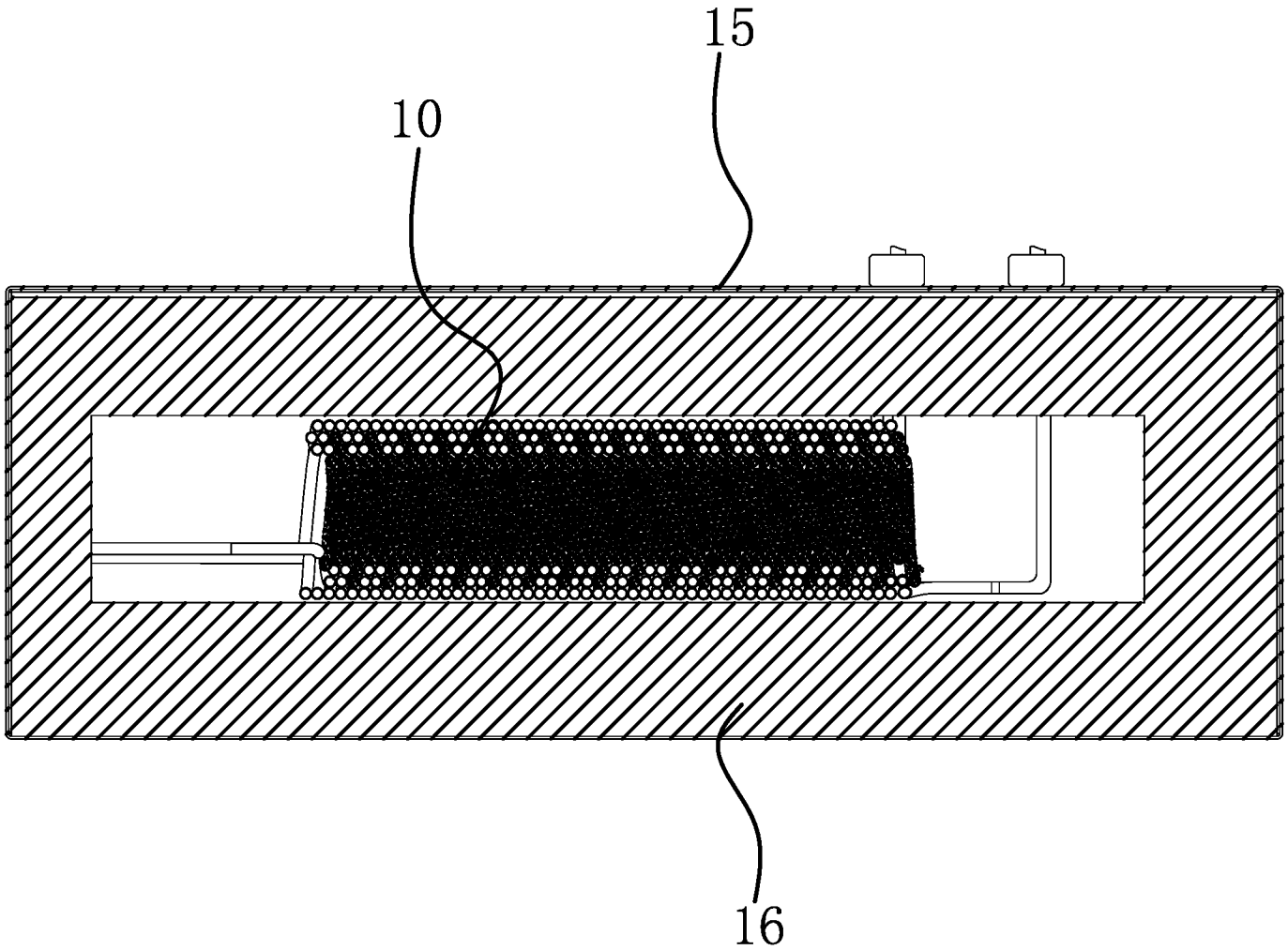
FIG. 9 is a sectional view of one embodiment of a quick cooler, a shell, and an insulation layer in the double cooled draft beer machine.

Specifically, as shown in FIG. 6, FIG. 7, and FIG. 8, the quick cooler (10) is formed by winding one refrigeration tube (9) and two beer pipes (7). The quick cooler (10) comprises at least one mixing layer (10*a*), which is formed by winding the refrigeration tube (9) and the beer pipe (7) into a round or elliptic cylinder, in an abreast and helical manner. In the same mixing layer (10*a*), the adjacent beer pipe (7) and refrigeration tube (9) adhere to each other. The adjacent two mixing layers (10*a*) directly adhere or a thermal conductive medium is filled in between the two layers. The thermal conductive medium is temperature conductive mud or aluminum powder. Each beer pipe (7) is wound into each mixing layer (10*a*). A refrigeration layer (10*b*) is arranged inside the innermost mixing layer (10*a*). The refrigeration layer (10*b*) is formed by winding the refrigeration tubes (9) into a round or elliptic cylinder, in a helical manner. The refrigeration layer (10*b*) and the innermost mixing layer (10*a*) directly adhere or a thermal conductive medium is filled in between the two layers. A beer pipe layer (10*c*) is sleeved over the outside of the outermost mixing layer (10*a*). The beer pipe layer (10*c*) is formed by winding the beer pipes (7) into a round or elliptic cylinder, in a helical manner. The beer pipe layer (10*c*) and the outermost mixing layer (10*a*) directly adhere or a thermal conductive medium is filled in between the two layers. As shown in FIG. 9, a shell (15) used to hold the quick cooler (10) is arranged outside of the quick cooler (10). The quick cooler (10) is located inside the shell (15), and an insulation layer (16) is set up between the quick cooler (10) and the inner wall of the shell (15). The mixing layer (10*a*) has a multiple layer structure. On one hand, the contact length between the refrigeration tube (9) and the beer pipe (7) is increased, the refrigeration path is increased and hence the refrigeration effect is improved; on the other hand, the refrigeration tube (9) in each mixing layer (10*a*) can refrigerate the beer pipe (7) in the adjacent mixing layer (10*a*), and the cooling capacity of the refrigeration tube (9) is utilized more efficiently, so as to improve the refrigeration effect.

Figure 10:
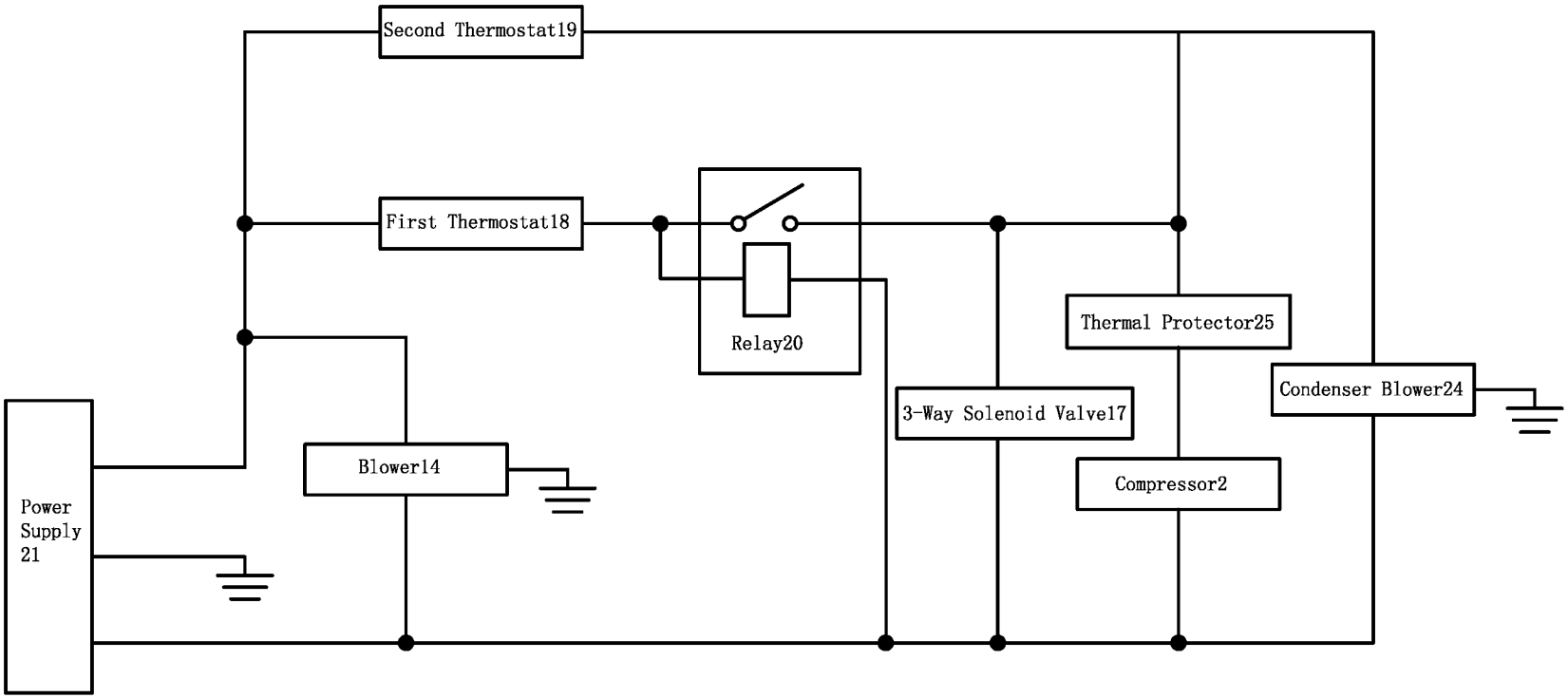
FIG. 10 is a schematic illustration of a first electrical circuit connection diagram of a first embodiment.
Figure 11:
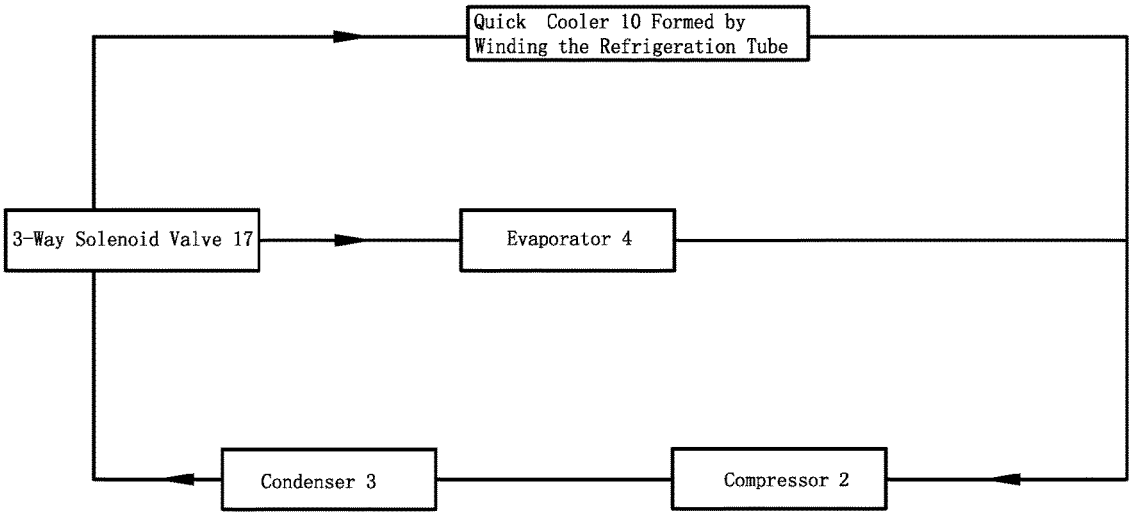
FIG. 11 is a schematic illustration of a second electrical circuit connection diagram of a first embodiment.

As shown in FIG. 10 and FIG. 11, the refrigeration circuit of the present draft beer machine also comprises a solenoid valve used to open or close the refrigeration circuit for the refrigerant to flow toward the refrigeration tube (9) or the evaporator (4), a relay (20) used to control the action of the solenoid valve, and the first thermostat (18) used to detect the temperature of the inflowing beer of the beer pipe (7). The first thermostat (18) is in parallel with the relay (20), and the contact of the relay (20) is connected to the solenoid of the solenoid valve, as well as the compressor (2). When the temperature detected by the first thermostat (18) is higher than the first upper limit temperature threshold set by the first thermostat (18), the relay (20) controls the solenoid valve to allow the refrigerant in the refrigeration circuit to stop flowing toward the evaporator (4), and to flow toward the refrigeration tube (9) only. When the temperature detected by the first thermostat (18) is equal to or lower than the first lower limit temperature threshold set by the first thermostat (18), the relay (20) controls the solenoid valve to allow the refrigerant in the refrigeration circuit to stop flowing toward the refrigeration tube (9). The current input terminal of the electromagnetic coil of the relay (20) and the contact of the relay (20) are connected to one end of the first thermostat (18), and the other end of the first thermostat (18) is connected to a power supply (21). The current output terminal of the electromagnetic coil of the relay (20) is connected to the power supply to form a circuit. The other contact of the relay (20) is connected to the current input terminal of the solenoid valve and the current input terminal of the compressor (2) respectively. The current output terminal of the solenoid valve and the current output terminal of the compressor (2) are connected to the power supply (21). One end of the second thermostat (19) is connected to the power supply (21), and the other end is connected to the current input terminal of the compressor (2). A thermal protector (25), which can prevent the compressor (2) from overheating, is also connected between the current input terminal of the compressor (2) and the second thermostat (19). The first thermostat (18) is arranged between the beer pipe layer (10*c*) and the outermost mixing layer (10*a*), and the detection point of the first thermostat (18) is close to the outlet end of the beer pipe (7) of the quick cooler (10).

The solenoid valve (17) is a 3-way solenoid valve. The inlet of the 3-way solenoid valve (17) is connected to the refrigerant outlet of the condenser (3), one outlet of the 3-way solenoid valve (17) is connected to the refrigeration tube (9), and the other outlet is connected to the evaporator (4). The second thermostat (19) which can detect the inner temperature of the cold storage chamber (6) is arranged inside the cold storage chamber (6). The second thermostat (19) is in series with a series branch consisting of the first thermostat (18) and the relay (20). When the temperature detected by the first thermostat (18) is equal to or lower than the first lower limit temperature threshold, and the inner temperature of the cold storage chamber (6) is higher than the second upper limit temperature threshold set by the second thermostat (19), the relay (20) controls the 3-way solenoid valve (17) to allow the refrigerant in the refrigeration circuit to flow toward the evaporator (4). When the temperature detected by the first thermostat (18) is equal to or lower than the first lower limit temperature threshold, and the inner temperature of the cold storage chamber (6) is equal to or lower than the second lower limit temperature threshold set by the second thermostat (19), the second thermostat (19) switches off and makes the compressor (2) stop working.

The present draft beer machine achieves the refrigeration to the evaporator (4) and the refrigeration tube (9) respectively through one compressor (2). Since when the temperature detected by the first thermostat (18) is higher than the first upper limit temperature threshold set by the first thermostat (18), the relay (20) controls the 3-way solenoid valve (17) to allow the refrigerant in the refrigeration circuit to flow toward the refrigeration tube (9) only. Therefore, regarding the distribution of the cooling capacity, the present draft beer machine refrigerates the beer pipe first. This is reflected in that:

On one hand, when the draft beer machine is switched on and in operation, the temperature of the cold storage chamber (6) and the temperature inside the beer pipe (7) are both relatively high. At this point, the 3-way solenoid valve (17) makes the refrigerant flow toward the refrigeration tube (9) only, and the beer pipe (7) is refrigerated first. When the temperature of the beer pipe (7) is equal to or lower than the first lower limit temperature threshold, it is then switched to refrigerate the cold storage chamber (6). This manner can ensure that the draft beer machine can fulfill the refrigeration of discharged beer quickly, features of "pre-cooling no longer needed" and "switch on and ready to use" are achieved. On the other hand, during the refrigeration process of the cold storage chamber (6), no matter whether the cold storage chamber (6) reaches the appropriate temperature range or not, if the beer tap (8) is opened frequently to discharge beer, the temperature detected by the first thermostat (18) is higher than the first upper limit temperature threshold set by the first thermostat (18). At this point, the relay (20) will control the 3-way solenoid valve (17) to act and forcibly switch, to allow the refrigerant in the refrigeration circuit to stop flowing toward the evaporator (4), and to flow toward the refrigeration tube (9) only. The beer pipe (7) is then refrigerated so as to ensure cool beer can be served whenever the beer tap is opened.

Second Embodiment

The structure and principle of this embodiment are basically the same as that of the first embodiment. The differences are:

An elliptic cylindrical quick cooler (10) is formed by winding the refrigeration tubes (9) and beer pipes (7) in a helical manner.

Third Embodiment

The structure and principle of this embodiment is basically the same as that of the first embodiment or the second embodiment. The differences are:

The quick cooler (10) is formed by winding one refrigeration tube (9) and one beer pipe (7), or by winding one beer pipe (7) and at least three refrigeration tubes (9).

Fourth Embodiment

Figure 12:
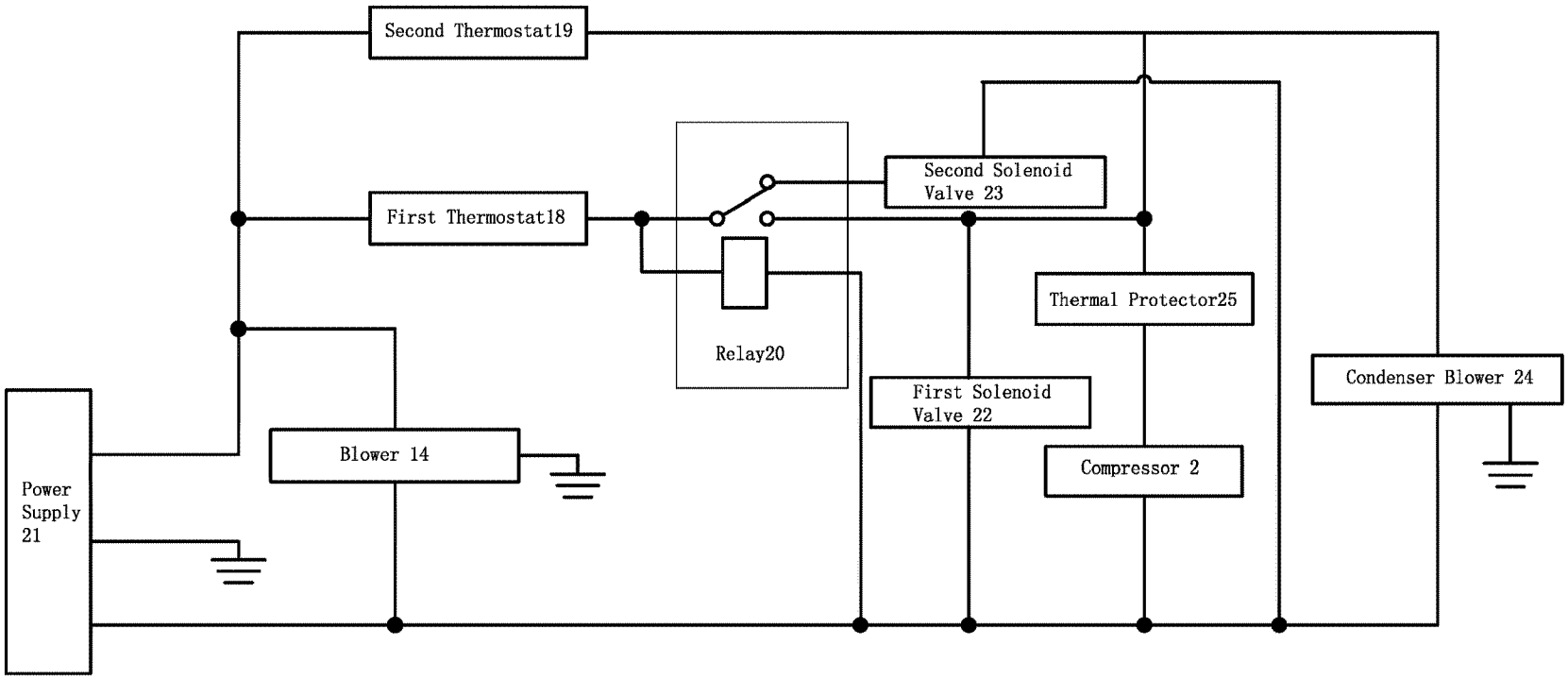
FIG. 12 is a schematic illustration of a first electrical circuit connection diagram of a second embodiment.
Figure 13:
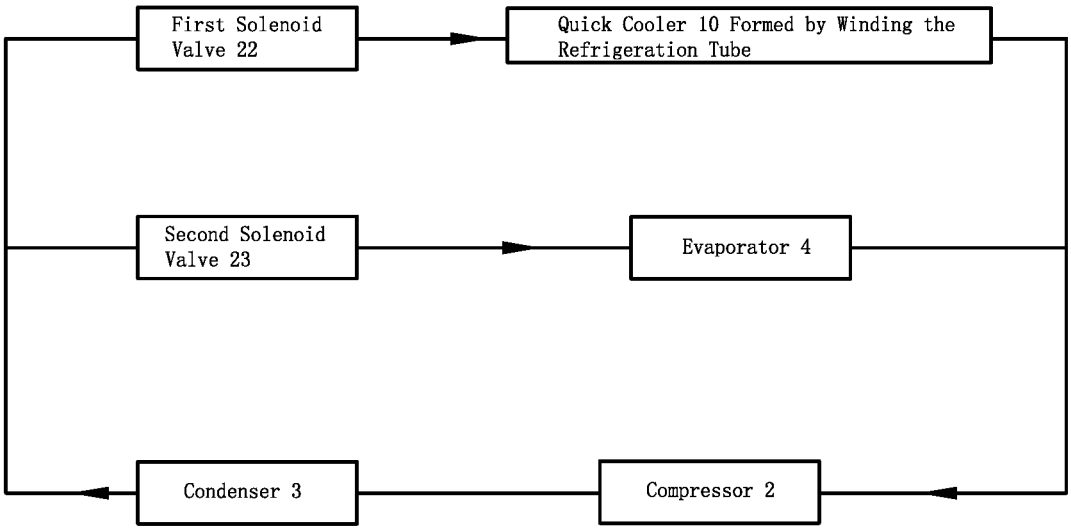
FIG. 13 is a schematic illustration of a second electrical circuit connection diagram of a second embodiment.

The structure and principle of this embodiment are basically the same as that of the first embodiment or the second embodiment or the third embodiment. The differences are:

As shown in FIG. 12 and FIG. 13, there are two solenoid valves: the first solenoid valve (22) and the second solenoid valve (23). The inlet of the first solenoid valve (22) is connected to the refrigerant outlet of the condenser (3), and the outlet is connected to the refrigeration tube (9). The inlet of the second solenoid valve (23) is connected to the refrigerant outlet of the condenser (3), and the outlet is connected to the evaporator (4). The relay (20) has both a normally open contact and a normally closed contact. The normally open contact is connected to the first solenoid valve (22) and the normally closed contact is connected to the second solenoid valve (23).

The description of the preferred embodiments thereof serves only as an illustration of the spirit of the invention. It will be understood by those skilled in the art that various changes or supplements in form and details may be made therein without departing from the spirit and scope of the invention as defined by the appended claims.

Although the terms of Cabinet (1), housing (1*a*), inner container (1*b*), Compressor (2), Condenser (3), evaporator (4), cask (5), cold storage chamber (6), beer pipe (7), beer tap (8), refrigeration tube (9), quick cooler (10), mixing layer (10*a*), refrigeration layer (10*b*), beer pipe layer (10*c*), door (11), mounting cover (13), blower (14), shell (15), insulation layer (16), etc. are often used herein, it does not exclude the possibility to use any other terms. Using such terms is only to describe or explain the nature of the present invention more conveniently. Any additional restrictions are contrary to the spirit of the present invention.

LIST OF REFERENCE NUMERALS

1 Cabinet
1*a* Housing
1*b* Inner Container
2 Compressor
3 Condenser
4 Evaporator
5 Cask
6 Cold Storage Chamber
7 Beer Pipe
8 Beer Tap
9 Refrigeration Tube
10 Quick Cooler
10*a* Mixing Layer
10*b* Refrigeration Layer
10*c* Beer Pipe Layer
11 Door
13 Mounting Cover
14 Blower
15 Shell
16 Insulation Layer
17 3-Way Solenoid Valve
18 First Thermostat
19 Second Thermostat
20 Relay
21 Power Supply
22 First Solenoid Valve
23 Second Solenoid Valve
24 Condenser Blower
25 Thermal Protector

What is claimed is:

1. A double cooled draft beer machine, comprising:
a cabinet;
a refrigeration circuit inside the cabinet, the refrigeration circuit including a compressor, a condenser, and an evaporator;
a cold storage chamber inside the cabinet, the cold storage chamber capable of holding a cask, and the evaporator capable of refrigerating the cold storage chamber;
a beer pipe arranged inside the cabinet;
a beer tap fixed to an outside of the cabinet;
an outer end of the beer pipe is connected to the beer tap;
an inner end of the beer pipe capable of connecting to the cask; and
a refrigeration tube inside the cold storage chamber;
wherein the refrigeration tube is connected to the refrigeration circuit and is in parallel with the evaporator;
wherein the refrigeration tube and the beer pipe are wound into a quick cooler of a round or an elliptic cylindrical shape; and
wherein the quick cooler comprises at least one mixing layer of a round or elliptic helical cylinder shape formed by winding the refrigeration tube and the beer pipe in an abreast and helical manner, each of the at least one mixing layer is helical, each turn of the wound refrigeration tube between two turns of the wound beer pipe is abutted and adhered to the two turns of the wound beer pipe in each of the at least one mixing layer.

2. The double cooled draft beer machine as claimed in claim 1, further comprising:
a door capable of opening or closing the cold storage chamber, the door arranged at a front of the cabinet;

wherein the quick cooler is located at a rear of the cold storage chamber.

3. The double cooled draft beer machine as claimed in claim 2 wherein the cabinet comprises a housing and an inner container, the inner container arranged inside the housing;

wherein the cold storage chamber is in an inner cavity of the inner container; and wherein there is a space between an outer wall of the inner container and an inner wall of the housing.

4. The double cooled draft beer machine as claimed in claim 3 wherein a mounting cover is fixed to a top of an inner wall of the inner container;

wherein the evaporator is arranged between the mounting cover and the inner container; and wherein on the mounting cover, there is a blower capable of blowing cold air diffused from the evaporator into the cold storage chamber.

5. The double cooled draft beer machine as claimed in claim 4 wherein a refrigeration layer is arranged inside an innermost mixing layer of the at least one mixing layer;

wherein the refrigeration layer is formed by winding the refrigeration tubes into a round or elliptic cylinder, in a helical manner; and wherein the refrigeration layer and the innermost mixing layer of the at least one mixing layer adhere to each other, either directly or with a thermal conductive medium filled in between the refrigeration layer and the innermost mixing layer of the at least one mixing layer.

6. The double cooled draft beer machine as claimed in claim 5 wherein a beer pipe layer is sleeved over an outside of an outermost mixing layer of the at least one mixing layer;

wherein the beer pipe layer is formed by winding beer pipes into a round or elliptic cylinder, in a helical manner; and wherein the beer pipe layer and the outermost mixing layer of the at least one mixing layer adhere to each other, either directly or with a thermal conductive medium filled in between the beer pipe layer and the outermost mixing layer of the at least one mixing layer.

7. The double cooled draft beer machine as claimed in claim 6 wherein the quick cooler is formed by winding one refrigeration tube and at least two beer pipes; and wherein each beer pipe is wound into each mixing layer of the at least one mixing layer.

8. The double cooled draft beer machine as claimed in claim 7 wherein a shell used to hold the quick cooler is arranged outside of the quick cooler;

wherein the quick cooler is located inside the shell; and wherein an insulation layer is set up between the quick cooler and an inner wall of the shell.

9. The double cooled draft beer machine as claimed in claim 4 wherein there are at least two adjacent mixing layers; and wherein the at least two adjacent mixing layers adhere to each other, either directly or with a thermal conductive medium filled in between the at least two adjacent mixing layers.

10. The double cooled draft beer machine as claimed in claim 9 wherein a refrigeration layer is arranged inside an innermost mixing layer of the at least two adjacent mixing layers;

wherein the refrigeration layer is formed by winding the refrigeration tubes into a round or elliptic cylinder, in a helical manner; and wherein the refrigeration layer and the innermost mixing layer of the at least two adjacent mixing layers adhere to each other, either directly or with a thermal conductive medium filled in between the refrigeration layer and the innermost mixing layer of the at least two adjacent mixing layers.

11. The double cooled draft beer machine as claimed in claim 10 wherein a beer pipe layer is sleeved over an outside of an outermost mixing layer of the at least two adjacent mixing layers;

wherein the beer pipe layer is formed by winding beer pipes into a round or elliptic cylinder, in a helical manner; and wherein the beer pipe layer and the outermost mixing layer of the at least two adjacent mixing layers adhere to each other, either directly or with a thermal conductive medium filled in between the beer pipe layer and the outermost mixing layer of the at least two adjacent mixing layers.

12. The double cooled draft beer machine as claimed in claim 11 wherein the quick cooler is formed by winding one refrigeration tube and at least two beer pipes; and wherein each beer pipe is wound into each mixing layer of the at least two adjacent mixing layers continuously.

13. The double cooled draft beer machine as claimed in claim 12 wherein a shell used to hold the quick cooler is arranged outside of the quick cooler;

wherein the quick cooler is located inside the shell; and wherein an insulation layer is set up between the quick cooler and an inner wall of the shell.

14. The double cooled draft beer machine as claimed in claim 9 wherein at least one solenoid valve, including a first solenoid valve, is part of the refrigeration circuit;

wherein the first solenoid valve is capable of opening or closing the refrigeration circuit for refrigerant to flow toward the refrigeration tube or the evaporator;

wherein the double cooled draft beer machine further comprises a relay capable of controlling an action of the first solenoid valve, and a first thermostat capable of detecting temperature;

wherein a detection point of the first thermostat is located between the refrigeration tube and the beer pipe;

wherein the first thermostat is in parallel with the relay; and wherein a contact of the relay is connected to the compressor and to a solenoid of the first solenoid valve;

wherein when the temperature detected by the first thermostat is higher than a first upper limit temperature threshold set by the first thermostat, the relay controls the first solenoid valve to allow the refrigerant in the refrigeration circuit to stop flowing toward the evaporator, and to flow only toward the refrigeration tube; and wherein when the temperature detected by the first thermostat is equal to or lower than a first lower limit temperature threshold set by the first thermostat, the relay controls the first solenoid valve to allow the refrigerant in the refrigeration circuit to stop flowing toward the refrigeration tube.

15. The double cooled draft beer machine as claimed in claim 14 wherein a second thermostat that can detect an inner temperature of the cold storage chamber is arranged inside the cold storage chamber;

wherein the second thermostat is in series with a series branch consisting of the first thermostat and the relay;

wherein when the temperature detected by the first thermostat is equal to or lower than the first lower limit temperature threshold, and the inner temperature of the cold storage chamber is higher than a second upper limit temperature threshold set by the second thermostat, the relay controls the first solenoid valve to allow the refrigerant in the refrigeration circuit to flow toward the evaporator; and wherein when the temperature detected by the first thermostat is equal to or lower than the first lower limit temperature threshold, and the inner temperature of the cold storage chamber is equal to or lower than a second lower limit temperature threshold set by the second thermostat, the second thermostat switches off and causes the compressor to stop working.

16. The double cooled draft beer machine as claimed in claim 15 wherein the first solenoid valve is a three-way solenoid valve;

wherein an inlet of the three-way solenoid valve is connected to a refrigerant outlet of the condenser;

wherein a first outlet of the three-way solenoid valve is connected to the refrigeration tube; and wherein a second outlet of the three-way solenoid valve is connected to the evaporator.

17. The double cooled draft beer machine as claimed in claim 15 wherein a second solenoid valve is part of the refrigeration circuit and the first solenoid valve is a two-way solenoid valve;

wherein an inlet of the first solenoid valve is connected to a refrigerant outlet of the condenser;

wherein an outlet of the first solenoid valve is connected to the refrigeration tube;

wherein an inlet of the second solenoid valve is connected to the refrigerant outlet of the condenser;

wherein an outlet of the second solenoid valve is connected to the evaporator;

wherein the relay has both a normally open contact and a normally closed contact;

wherein the normally open contact is connected to the first solenoid valve; and wherein the normally closed contact is connected to the second solenoid valve.

18. The double cooled draft beer machine as claimed in claim 2 wherein in the refrigeration circuit, at least one solenoid valve is set up;

wherein the solenoid valve is capable of opening or closing the refrigeration circuit for refrigerant to flow toward the refrigeration tube or the evaporator;

wherein the double cooled draft beer machine further comprises a relay capable of controlling an action of the solenoid valve, and a first thermostat capable of detecting temperature;

wherein a detection point of the first thermostat is located between the refrigeration tube and the beer pipe;

wherein the first thermostat is in parallel with the relay; and wherein a contact of the relay is connected to the compressor and to a solenoid of the solenoid valve;

wherein when the temperature detected by the first thermostat is higher than a first upper limit temperature threshold set by the first thermostat, the relay controls the solenoid valve to allow the refrigerant in the refrigeration circuit to stop flowing toward the evaporator, and to flow only toward the refrigeration tube; and wherein when the temperature detected by the first thermostat is equal to or lower than a first lower limit temperature threshold set by the first thermostat, the relay controls the solenoid valve to allow the refrigerant in the refrigeration circuit to stop flowing toward the refrigeration tube.

19. The double cooled draft beer machine as claimed in claim 3 wherein in the refrigeration circuit, at least one solenoid valve is set up;

wherein the solenoid valve is capable of opening or closing the refrigeration circuit for refrigerant to flow toward the refrigeration tube or the evaporator;

wherein the double cooled draft beer machine further comprises a relay capable of controlling an action of the solenoid valve, and a first thermostat capable of detecting temperature;

wherein a detection point of the first thermostat is located between the refrigeration tube and the beer pipe;

wherein the first thermostat is in parallel with the relay; and wherein a contact of the relay is connected to the compressor and to a solenoid of the solenoid valve;

wherein when the temperature detected by the first thermostat is higher than a first upper limit temperature threshold set by the first thermostat, the relay controls the solenoid valve to allow the refrigerant in the refrigeration circuit to stop flowing toward the evaporator, and to flow only toward the refrigeration tube; and wherein when the temperature detected by the first thermostat is equal to or lower than a first lower limit temperature threshold set by the first thermostat, the relay controls the solenoid valve to allow the refrigerant in the refrigeration circuit to stop flowing toward the refrigeration tube.

* * * * *